US005721390A

United States Patent [19]

Adachi et al.

[11] Patent Number: 5,721,390

[45] Date of Patent: Feb. 24, 1998

[54] MUSICAL TONE SIGNAL PRODUCING APPARATUS WITH ENHANCED PROGRAM SELECTION

[75] Inventors: Jun Adachi, Sakura; Osamu Ohshima, Hamamatsu, both of Japan

[73] Assignee: Yamaha Corporation, Japan

[21] Appl. No.: 525,062

[22] Filed: Sep. 8, 1995

[30] Foreign Application Priority Data

Sep. 8, 1994 [JP] Japan ..... 6-214901

[51] Int. Cl.[6] ..... G10H 7/00

[52] U.S. Cl. ..... 84/602

[58] Field of Search ..... 84/601, 602

[56] References Cited

U.S. PATENT DOCUMENTS

| | | | |
|---|---|---|---|
| 5,038,660 | 8/1991 | Watanabe | 84/601 |
| 5,119,710 | 6/1992 | Tsurumi et al. | 84/601 X |
| 5,125,314 | 6/1992 | Chihana | 84/601 |
| 5,446,237 | 8/1995 | Abe et al. | 84/602 X |
| 5,448,009 | 9/1995 | Kudo | 84/602 |

FOREIGN PATENT DOCUMENTS

| | | |
|---|---|---|
| 2-19839 | 5/1990 | Japan . |
| 03121495A | 5/1991 | Japan . |

*Primary Examiner*—Stanley J. Witkowski
*Attorney, Agent, or Firm*—Rossi & Associates

[57] ABSTRACT

In a musical tone signal producing apparatus having a read-only memory of ROM for memorizing a start program and a random access memory or RAM for memorizing plural sets of system setting data and a designation data, a central processing unit or CPU is provided to execute the memorized start program to transfer an application program to the RAM from a hard disk. Immediately after started execution of the application program, the CPU sets a system environment of the apparatus on a basis of one set of the memorized system setting data designated by the designation data and changes the memorized system setting data and designation data during execution of the application program. During execution of the application program, the CPU executes sampling processing, trimming processing and mapping processing of the application program in sequence to produce a musical tone control data.

8 Claims, 12 Drawing Sheets

SOUND SYSTEM
D/A
MUSICAL TONE SIGNAL PRODUCING CIRCUIT
WAVEFORM DATA BUFFER MEMORY
EXTERNAL TONE INPUT INTERFACE
A/D
MIDI CIRCUIT
DRIVING CIRCUIT
DRIVING CIRCUIT
RAM
ROM
CPU
DISPLAY CONTROL CIRCUIT
OPERATION SWITCH CIRCUIT
10
21
22
22a
23
24
25
26
31
32
33
34
40
40a
41
41a
42
43
44
45
46
47
48
51
52
53
61
62
63
64

ROM
52
START PROGRAM
ST
RAM
53
CPU WORK AREA
ST1
ST2
ST3
STNO
APPLICATION PROGRAM AREA
HD (FD)
61 (63)
APPLICATION PROGRAM
APPLICATION PROGRAM
ST 1
ST n
WAVEFORM DATA (WV1～WVm)
MUSICAL TONE SIGNAL CONTROL DATA (TC1～TCm)
NAME
VOLUME
MTUNE
MIDIST
VOICEST
DIALOGST
SFREQ
SSEQF
TSEQF
MSEQF
DEVICE
APPLIC

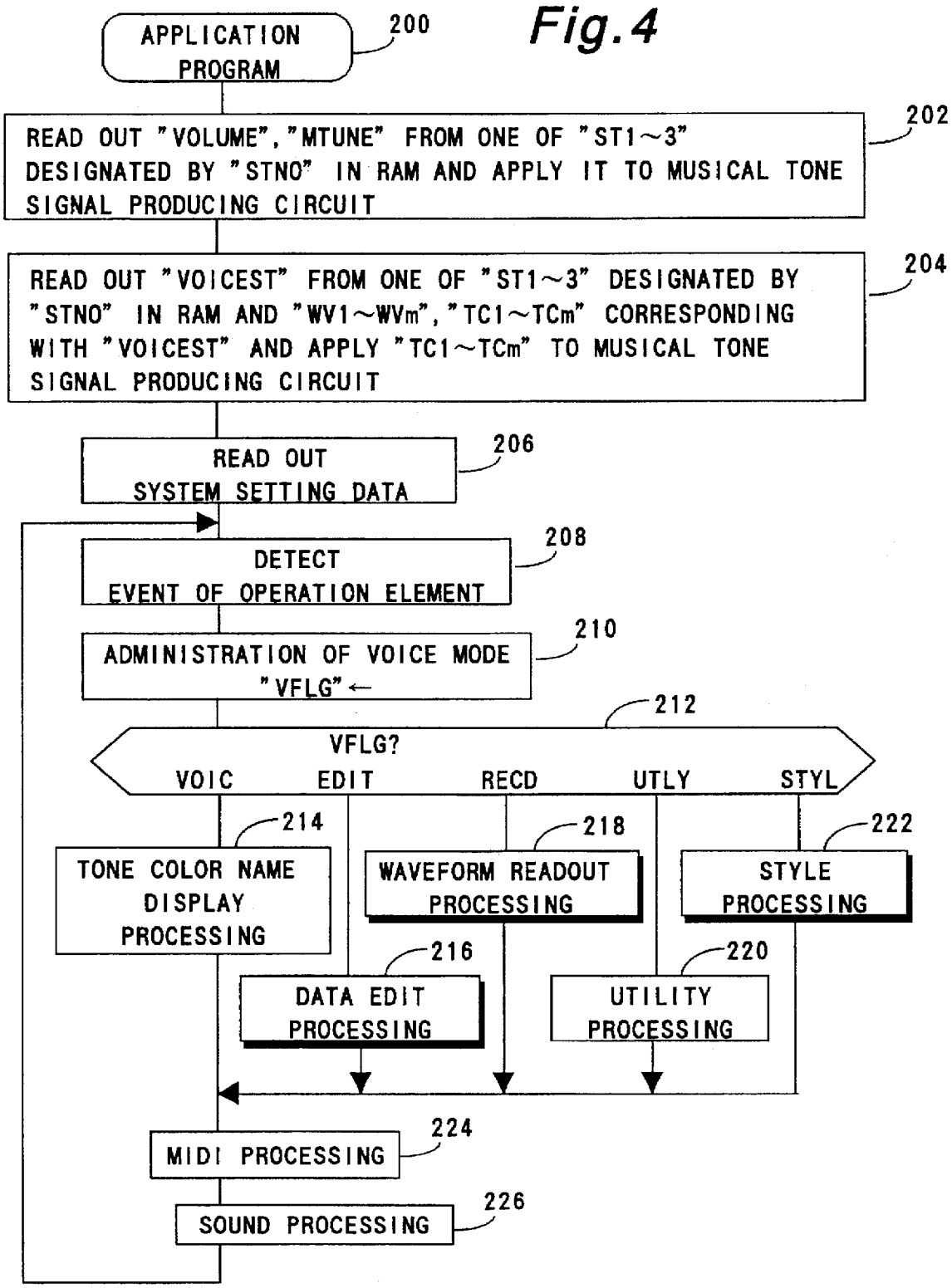
Fig.4
APPLICATION PROGRAM
200
READ OUT "VOLUME","MTUNE" FROM ONE OF "ST1~3" DESIGNATED BY "STNO" IN RAM AND APPLY IT TO MUSICAL TONE SIGNAL PRODUCING CIRCUIT
202
READ OUT "VOICEST" FROM ONE OF "ST1~3" DESIGNATED BY "STNO" IN RAM AND "WV1~WVm","TC1~TCm" CORRESPONDING WITH "VOICEST" AND APPLY "TC1~TCm" TO MUSICAL TONE SIGNAL PRODUCING CIRCUIT
204
READ OUT SYSTEM SETTING DATA
206
DETECT EVENT OF OPERATION ELEMENT
208
ADMINISTRATION OF VOICE MODE "VFLG"←
210
VFLG?
212
VOIC
EDIT
RECD
UTLY
STYL
TONE COLOR NAME DISPLAY PROCESSING
214
WAVEFORM READOUT PROCESSING
218
STYLE PROCESSING
222
DATA EDIT PROCESSING
216
UTILITY PROCESSING
220
MIDI PROCESSING
224
SOUND PROCESSING
226

MUSICAL TONE SIGNAL PRODUCING APPARATUS WITH ENHANCED PROGRAM SELECTION

BACKGROUND OF THE INVENTION

1. Field of the Invention

The present invention relates to a musical tone signal producing apparatus of the type wherein musical tone signal control data are produced by processing of a control program for production of a musical tone signal.

2. Description of the Prior Art

In a conventional musical tone signal producing apparatus of this kind, a central processing unit starts to execute a start program stored in a memory device for starting execution of an application program stored therein. Immediately after started execution of the application program, the central processing unit sets a system environment based on plural system setting data such as a master tuning data, a sampling frequency data, a total tone volume data and designation of the memory device for producing musical tone signal data.

In such a conventional apparatus, however, the system environment set by execution of the application program is constantly fixed. Accordingly, when it is desired to change the system environment in accordance with the user's choice, the user is obliged to change the system environment on each occasion, resulting in difficulty in operation of the user at start of the system. Additionally, since the musical tone control data are successively produced by multiple processing steps, it is required to effect transition of the multiple processing steps based on various types of menus. In the case that the number of processing steps is small, there is not any problem in the contents of the menus. However, in the case that the number of processing steps is increased as in a recent musical tone signal producing apparatus, the contents of the menus become complicated, resulting in difficulty in operability of the apparatus.

SUMMARY OF THE INVENTION

It is, therefore, a primary object of the present invention to provide a musical tone signal producing apparatus the program processing of which is arranged to enhance operability of the apparatus at its start for operation and in production of musical tone control data.

According to the present invention, the object is accomplished by providing a musical tone signal producing apparatus of the type which includes memory means for memorizing a start program and an application program for control of production of a musical tone control data and a musical tone signal based thereon and a central processing unit for executing the start program at its start for operation to start execution of the application program, wherein the memory means is adapted to memorize plural sets of system setting data and a designation data for designating either one set of the system setting data, and wherein the central processing unit is adapted to set a system environment based on the system setting data designated by the designation data immediately after started execution of the application program and to change the memorized system setting data and designation data during execution of the application program.

According to an aspect of the present invention, the memory means comprises a read-only memory, a nonvolatile random access memory and a disk memory, the read-only memory being adapted to memorize the start program, the disk memory being adapted to memorize plural kinds of application programs, and the random access memory being adapted to memorize the plural sets of system setting data and the designation data and to store an application data for designating either one of the application programs into the system setting data, and wherein the central processing unit is arranged to designate either one set of the system setting data based on the designation data during execution of the start program and to transfer one of the application programs designated by the application data to the random access memory from the disk memory and executes the transferred application program.

According to another aspect of the present invention, there is provided a musical tone signal producing apparatus of the type which includes memory means for memorizing a control program for production of a musical tone control data and a musical tone signal based thereon and a central processing unit for execution of the control program, wherein a portion of the control program includes plural processing steps to be executed by the central processing unit in sequence, and wherein the memory means is adapted to memorize a step control data for each execution of the plural processing steps so that the central processing unit executes the control program based on the memorized step control data to produce the musical control data.

BRIEF DESCRIPTION OF THE DRAWINGS

Other objects, features and advantages of the present invention will be more readily appreciated from the following detailed description of a preferred embodiment thereof when taken together with the accompanying drawings, in which:

FIG. 4 is a flow chart of an application program memorized in the ROM, hard disk and flexible disk shown in FIG. 1;

DESCRIPTION OF THE PREFERRED EMBODIMENT

Figure 1:
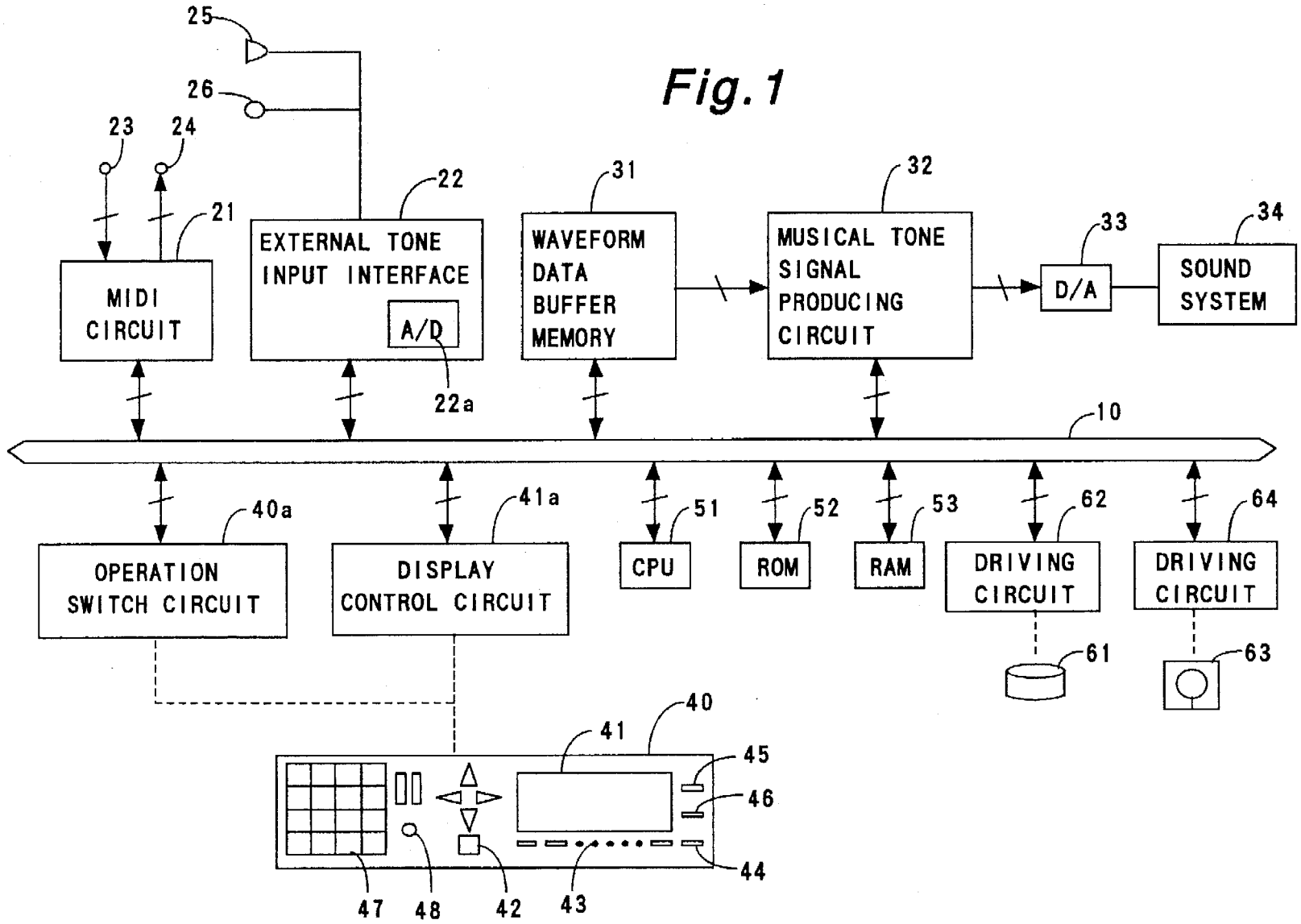
FIG. 1 is a block diagram of a musical tone signal producing apparatus in accordance with the present invention.

In FIG. 1 of the drawings, there is schematically illustrated a musical tone signal producing apparatus in accordance with the present invention which includes a musical instrument digital interface or MIDI circuit 21, an external tone input interface circuit 22, a waveform data buffer memory 31 and a musical tone signal producing circuit 32. The MIDI circuit 21, interface circuit 22, buffer memory 31 and musical tone signal producing circuit 32 are connected to a bus line 10. The MIDI circuit 21 has a MIDI input terminal 23 connected to the other electronic instrument such as an electronic musical instrument, an electronic automatic performance apparatus, a personal computer device, a memory device or the like to be applied with a MIDI data therefrom for supplying the MIDI data to another internal circuit in the musical tone signal producing apparatus through the bus line 10. A MIDI output terminal 24 of MIDI circuit 21 is supplied with the MIDI data from the internal circuit through the bus line 10 for applying it to the other electronic instrument. The MIDI data is a general term of performance control data for generation of a musical tune standardized as a musical instrument digital interface or MIDI. In this embodiment, the MIDI data includes a tone pitch data, a key-on data, a key-off data, a key-touch data and the like.

The external tone input interface circuit 22 includes an analog-to-digital or A/D converter which is provided to convert analog signals of a musical instrumental tone, a human voice or the like picked up by a microphone 25 and analog signals applied from another acoustic instrument through a line input terminal 26 into digital acoustic signals and to apply the digital acoustic signals to the other internal circuit of the musical tone signal producing apparatus through the bus line 10. The waveform buffer memory 31 is in the form of a random access memory or RAM which is provided to memorize waveform data representing each waveform of the musical instrumental tone and human voice. The musical tone signal producing circuit 32 repeatedly reads out the waveform data at a rate corresponding with a designated tone pitch and controls an amplitude envelope and a frequency characteristic of the read out waveform data to produce a digital musical tone signal therefrom. The musical tone signal producing circuit 32 is connected to a digital-to-analog or D/A converter 33 which converts the digital musical tone signal into an analog musical tone signal for applying it to a sound system 34. The sound system 34 is composed of an amplifier and a loudspeaker for sounding a musical tone.

Connected to the bus line 10 are an operation switch circuit 40*a* including a plurality of operation switches arranged to be operated by various operation elements on an operation panel 40 and a display control circuit 41*a* for an indicator 41 on the operation panel 40. The operation panel 40 is provided with a power source switch 42, eight function keys 43 (FSW1–FSW8) and a shift key 44 located beneath the indicator 41, an exit key 45 and an entry key 46 located at one side of the indicator 41, and other operation elements such as a ten-key 47, a slider, a jog dial, a movement key 48 for a cursor. Connected further to the bus line 10 are a central processing unit or CPU 51 of a microcomputer for control of the internal circuits of the musical tone signal producing apparatus, a read-only memory or ROM 52, a random access memory or RAM 53, a driving circuit 62 for driving a hard disk 61 and a driving circuit 64 for driving a flexible disk 63 used as an external memory medium.

Figure 2:
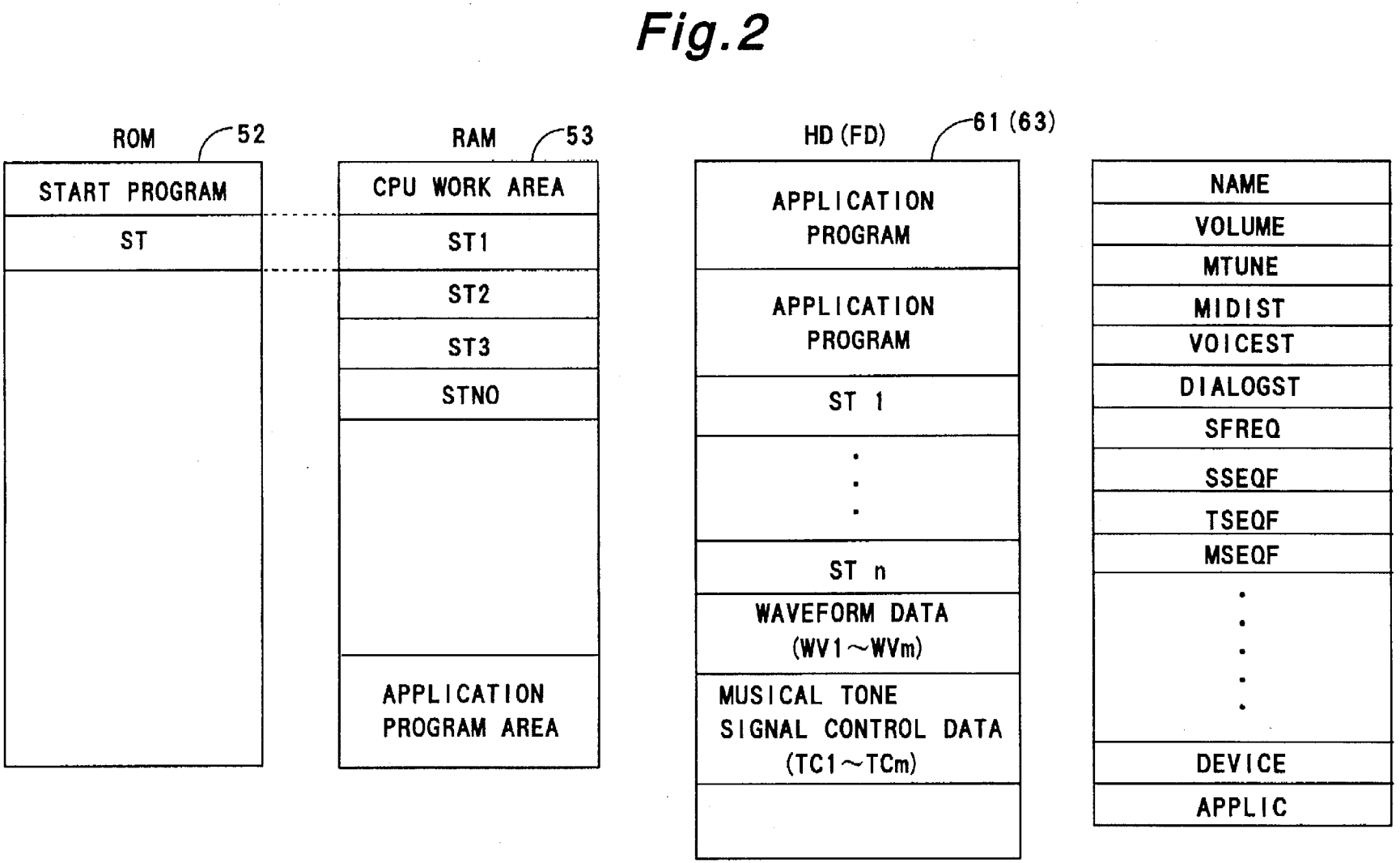
FIG. 2 is an illustration of memory maps for a read-only memory or ROM, a random access memory or RAM, a hard disk and a flexible disk shown in FIG. 1.

In FIG. 2, there is illustrated each memory map for the ROM 51, RAM 53, hard disk 61 and flexible disk 63. The ROM 52 is prepared at shipment of the musical tone signal producing apparatus to memorize a start program shown by a flow chart in FIG. 3 and minimum system setting data in a style data ST necessary for operation of the musical tone signal producing apparatus. In this embodiment, the style data is used as a general term of system setting data for jetting various system environments for operation of the internal circuits of the apparatus. The main contents of the system setting data are listed below.

NAME: Data indicative of a name of the style data

VOLUME: Data for determining a tone volume at start of the musical tone signal producing apparatus MTUNE: Data for defining an absolute frequency (for instance, 400 Hz) of a standard tone pitch (A4 or A4) of respective tone pitch frequencies MIDIST: Control data for input/output channels of a MIDI data VOICEST: Data for designating a tone color or a group of tone colors at start of the musical tone signal producing apparatus DIALOGST: Data indicative of presence or absence of check of a file name, an alarm, etc. at a save time of various data SFREQ: Data indicative of a sampling rate of an external sound signal at start of the musical tone producing apparatus SSEQF: Flag indicative of presence or absence of execution of a sampling at a sequence mode of a waveform readout processing TSEQF: Flag indicative of presence or absence of execution of a trimming at a sequence mode of the waveform readout processing MSEQF: Flag indicative of presence or absence of execution of a mapping or allotment of a tone area of a sampling waveform data at the sequence mode of the waveform readout processing DEVICE: Data for designating a memory device to be approached for reading out an application program at start of the musical tone signal producing apparatus APPLIC: Data for designating the kind (version, a file name, etc.) of an application program to be executed at start of the musical tone signal producing apparatus The RAM 53 is in the form of a nonvolatile writable memory which is provided with a working area for the CPU 51 and a memory area for an application program shown by flow charts in FIGS. 4 to 8. The RAM 53 is adapted to memorize three kinds of style data "ST1–ST3" and a style number "STN0" for designating either one of the style data "ST1–ST3". The hard disk 61 or flexible disk 63 is adapted to memorize plural kinds of application programs different in their specification and control function and various different style data "ST1–STn". The hard disk 61 or flexible disk 63 is also adapted to memorize a number of waveform data WV1–WVm indicative of various musical tone waveforms and tone color control data "TC1–TCm" for control of each amplitude envelope and frequency characteristic of the musical tone waveforms. The programs and data of the RAM 53 and hard disk 61 are read out by a user or a service engineer from a flexible disk when the musical tone signal producing apparatus has been bought.

Hereinafter, operation of the musical tone signal producing apparatus will be described with reference to the flow charts shown in FIGS. 3–8. Assuming that the circuits of FIG. 1 have been supplied with an electric power from a source of electricity (not shown), the CPU 51 starts at step 100 of FIG. 3 to execute the start program memorized in the ROM 52. Thus, the CPU 51 checks each memory device of the circuits at step 102 and reads out a style number STN0 from the RAM 53 at step 104. Subsequently, the CPU 51 reads out at step 106 a device data "DEVICE" and an application data "APPLIC" from one of the style data "ST1–ST3" designated by the style number "STN0" in the RAM 53 and reads out at step 108 an application program corresponding with the application data "APPLIC" from the hard disk 61 or flexible disk 63 designated by the device data "DEVICE" through the driving circuit 62 or 64 to make the RAM 53 in a loaded condition. In turn, the CPU 51 starts at step 110 execution of the application program loaded in the RAM 53 and finishes the execution of the start program at step 112. In case the style number STN0 and style data ST1–ST3 have not been found in the RAM 53 during processing at step 104 and 106, the CPU S1 reads out the style data "ST" from the ROM 52.

When started execution of the application program at step 200, the CPU 51 reads out at step 202 the style number "STN0" from the RAM 53 and reads out a tone volume data "VOLUME" and a tuning data "MTUNE" from one of the style data "ST1–ST3" designated by the style number "STN0" in the RAM 53 to supply them to the musical tone signal producing circuit 32. Thus, the musical tone signal producing circuit 32 memorizes the tone volume data "VOLUME" and tuning data "MTUNE" and determines each tone pitch frequency of musical tone signals to be produced in accordance with a standard frequency defined by the memorized tuning data "MTUNE" and to control a total volume level of the musical tone signals in accordance with the tone volume data "VOLUME".

When the program proceeds to step 204, the CPU 51 reads out a voice setting data "VOICEST" from one of the style data "ST1–ST3" designated by the style number "STN0" in the RAM 53 and reads out a waveform data "WVi" and a tone color control data "TCi (i=1–m)" corresponding with the voice setting data "VOICEST" from the waveform data "WV1–WVm" and tone color control data "TC1–TCm" memorized in the hard disk 61 through the driving circuit 62 to supply the waveform data "WVi" to the waveform data buffer memory 31 and to supply the tone color control data "TCi" to the musical tone signal producing circuit 32. Thus, the waveform data "WVi" is memorized in the waveform data buffer memory 31 and read out under control of the musical tone signal producing circuit 32 to be produced as a musical tone signal. The musical tone signal producing circuit 32 memorizes the supplied tone color control data "TCi" and acts to control an envelope and a frequency characteristic of the musical tone waveform signal in accordance with the tone color control data TCi.

After processing at step 204, the CPU 51 reads out at step 206 a system setting data from one of the style data ST1–ST3 designated by the style number STN0 and applies the system setting data to the MIDI circuit 21, the external tone input interface circuit 22 and the musical tone signal producing circuit 32 for setting a system environment of the musical tone signal producing apparatus. Thereafter, the CPU 51 repeats execution of processing at step 208 to 226.

At step 208, the CPU 51 detects at step 208 each situation of the internal switches of the operation switch circuit **40*a* thereby to detect each situation of the operation elements 43–48 on the operation panel 40. After processing at step 208, the CPU 51 executes at step 210 voice mode administration processing during which a voice mode flag "VFLG" for designation of either one of various voice modes such as a voice play mode "VOIC", an edit mode "EDIT", a recording mode "RECD", a utility mode "UTLY", a style mode "STYL" or the like is set in accordance with operation of the detected operation element. In this instance, if any one of the operation elements 43–48 has not be operated, the voice mode flag "VFLG" represents the voice play mode "VOIC" at an initial stage. Subsequently, the CPU 51 causes the program to proceed to step 212 to 222** in accordance with the voice mode flag VFLG as described below.

Assuming that the voice mode flag "VFLG" represents the voice play mode "VOIC", the program proceeds to step 214 where the CPU 51 reads out a voice setting data "VOICEST" from the style data designated by the style number "STN0" and supplies a tone color name data indicative of a name designated by the voice setting data "VOICEST" with the voice mode flag "VFLG" to the display control circuit **41*a*. When applied with the tone color name data, the display control circuit 41*a* causes the indicator 41 to display a tone color name (VOICE: 001 GRAND PIANO) designated by the tone color name data as shown in FIG. 9 and to display each character indicative of the voice play mode "VOIC", edit mode "EDIT", recording mode "RECD", utility mode "UTLY" and style mode "STYL" corresponding with the five function keys 43**.

After processing at step 214, the CPU 51 executes MIDI processing at step 224 and executes sound processing at step 226. During the MIDI processing at step 224, the CPU 51 transfers the MIDI data to the working area of the RAM 53 from the MIDI circuit 21. In this instance, the MIDI data is being memorized in the MIDI circuit 21 if it is designated as an input data by the MIDI setting data "MIDIST". In addition, the MIDI circuit 21 is supplied with the MIDI data for applying it to the external instrument from its output terminal 24. During the sound processing at step 226, the MIDI data transferred to the working area of the RAM 53 is processed for production of a musical tone signal and supplied to the musical tone signal producing circuit 32. When supplied with the MIDI data, the musical tone signal producing circuit 32 reads out the waveform data "WVi" (corresponding with the tone color designated by the voice setting data VOICEST) from the waveform data buffer memory 31 and controls an amplitude envelope and a frequency characteristic of the waveform data "WVi" in accordance with the tone color control data "TCi" to apply them as a digital musical tone signal to the D/A converter 33. In turn, the D/A converter 33 converts the digital musical tone signal into an analog musical tone signal, and the sound system 34 generates the analog musical tone signal as a musical sound. Thus, the musical sound is generated in response to the MIDI data supplied to the musical tone signal producing apparatus, and the tone color of the musical sound is controlled by the voice setting data designated by the style number "STN0" in the RAM 53.

Figure 5:
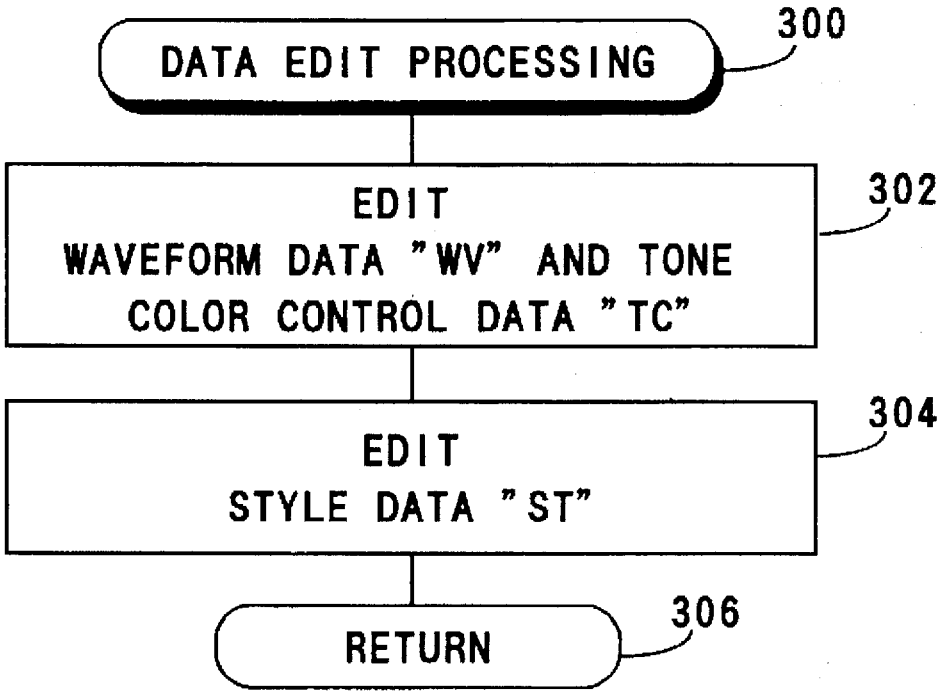
FIG. 5 is a flow chart of a data editing routine shown in FIG. 4.
Figure 9:
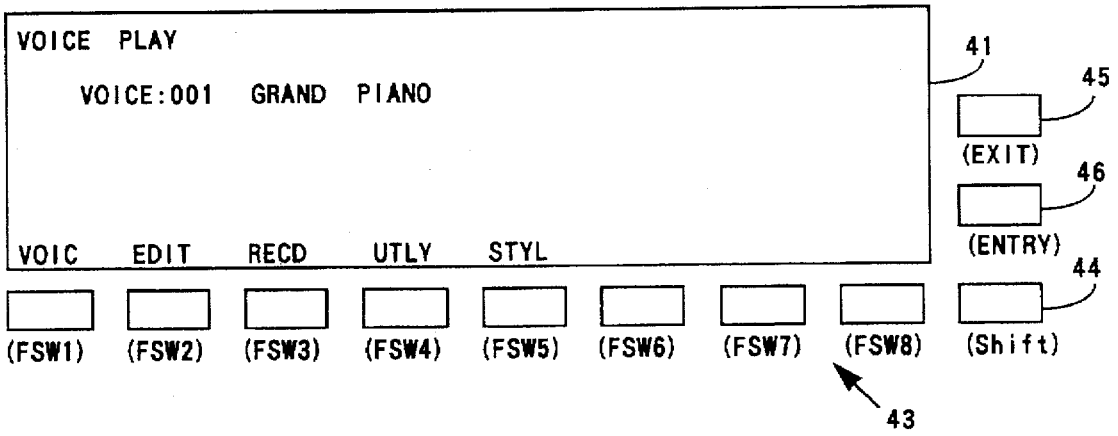
FIG. 9 depicts display of an indicator at a voice-play mode.

When the function key 43 indicated by the character "EDIT" of the edit mode is operated in a condition where the indicator 41 is in the display condition shown in FIG. 9, the voice mode flag "VFLG" represents the edit mode "EDIT" during processing at step 208 and 210, and the CPU 51 causes the program at step 212 to proceed to step 216 for the data edition processing routine shown in FIG. 5. When started execution of the data edit processing routine at step 300, the CPU 51 responds to operation of the ten-key 47 and operation element 48 at step 302 to edit the waveform data "WV" memorized in the waveform buffer memory 31 and hard disk 61 and to edit the tone color control data "TC" memorized in the musical tone signal producing circuit 32 and hard disk 61. The CPU 51 further responds to operation of the ten-key 47 and operation element 48 at step 304 to edit the style data "ST" memorized in the RAM 53 and hard disk 61. Thus, the waveform data "WV", tone color control data "TC" and style data "ST" can be freely changed by operation of the ten-key 47 and operation element 48.

Figure 10:
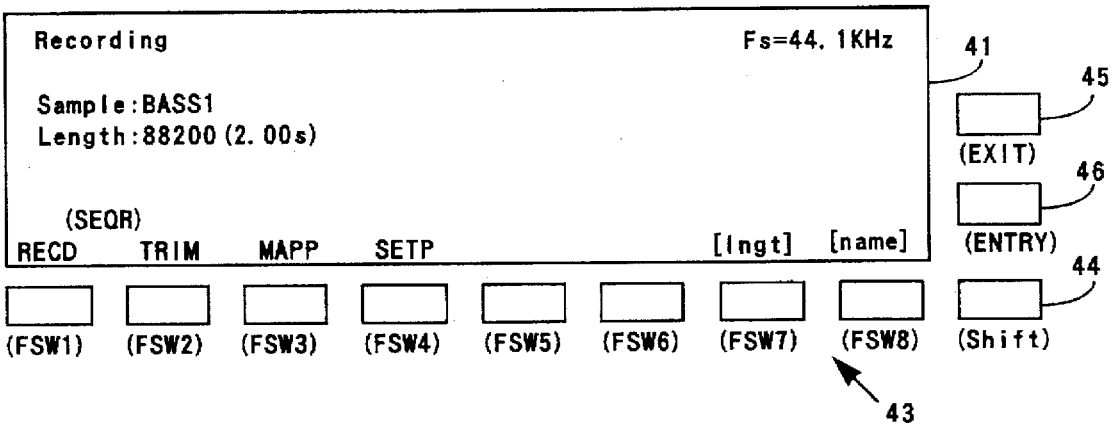
FIG. 10 depicts display of the indicator at a recording mode.

When the function key 43 indicated by the character "RECD" of the recording mode is operated in a condition where the indicator 41 is in a display condition shown in FIG. 10, the voice mode flag "VFLG" represents the recording mode "RECD" during processing at step 208 and 210. Thus, the CPU 51 causes the program at step 212 to proceed to step 218 for the waveform readout processing routine shown in FIG. 6. When started execution of the waveform readout processing routine at step 400, the CPU 51 executes at step 402 administration processing of the recording mode during which a recording mode flag "RFLG" for designating either one of a recording mode "RECD", a trimming mode "TRIM", a mapping mode "MAPP", a parameter setting mode "SETP" and a sequence mode"SEQR" is set in accordance with operation of the operation element detected by processing at step 208. In case any one of the operation elements 43–48 is not operated, the recording mode flag "RFLG" represents the recording mode "RECD" at an initial stage. Thus, the CPU 51 causes the program at step 404 to proceed to either one of steps 406–414 in accordance with the recording mode flag RFLG.

Assuming that the recording mode flag RFLG represents the recording mode "RECD", the CPU 51 causes the program at step 404 to proceed to step 406. At step 406, the CPU 51 reads out a sampling frequency data "SFREQ" from one of the style data designated by the style number "STN0" and other system setting data necessary for sampling an external input sound and supplies the read out sampling frequency data "SFREQ" and system setting data with the recording mode flag "RFLG" to the display control circuit 41*a*. In turn, the display control circuit 41*a* controls the indicator 41 on a basis of the supplied data to display the sampling frequency (Fs: 44.1 KHz) of the external input sound as shown in FIG. 10. In this instance, the indicator 41 displays thereon the characters indicative of the recording mode "RECD" (sequence mode "SEQR"), trimming mode "TRIM", mapping mode "MAPP" and parameter setting mode "SETP" and the characters indicative of the length and name corresponding with the two function keys 43. The function keys 43 corresponding with the characters indicative of the length and name designate the sampling data name "Sample" and the input time length "Length" of the external input sound. After operation of the function keys 43, the input time length (Length=88200(2.00 s) and the sampling data name (Sample: BASSI) are designated or changed by operation of the ten-key 47 and other operation elements 48 and displayed on the indicator 41.

When supplied with the analog external sound signals through the microphone 25 or line input terminal 28 in such a condition as described above, the external tone input interface circuit 22 selects one of the analog external sound signals with reference to the displayed sampling frequency "Fs", and the A/D converter 22*a* converts the selected analog external sound signal into a digital external tone signal. Thus, the CPU 51 causes the RAM 53 to read out the converted digital external tone signal as a musical tone waveform data "WV" for a period of time corresponding with the displayed time length. Thereafter, the CPU 51 responds to operation of the entry key 46 to write the read out musical tone waveform data "WV" with the designated sampling data name (Sample: BASSI) into the hard disk 61.

When the function keys 43 corresponding with the characters "RECD", "TRIM", "MAPP" and "SETP" of the recording mode, trimming mode, mapping mode and parameter setting mode are operated in a condition where the indicator 41 is in the display condition shown in FIG. 10, each operation of the function keys 43 is detected by processing at step 208 of FIG. 4, and the recording mode flag "RFLG" is set by processing at step 402 to represent the respective modes "RECD", "TRIM", "MAPP", "SETP". Thus, the CPU 51 causes the program at step 404 to proceed to step 406 to 412. When the shift key 44 is operated with the function key 43 corresponding with the character of the recording mode "RECD" (sequence mode "SEQR") in such a condition as described above, each operation of the shift key 44 and function key 43 is detected by processing at step 208 of FIG. 4, and the recording mode flag "RFLG" is set by processing at step 402 to represent the frequency mode "SEQR". Thus, the CPU 51 causes the program at step 404 to proceed to step 414. During processing at step 408 to 414, the modes are changed in the same manner as described above.

Figure 11:
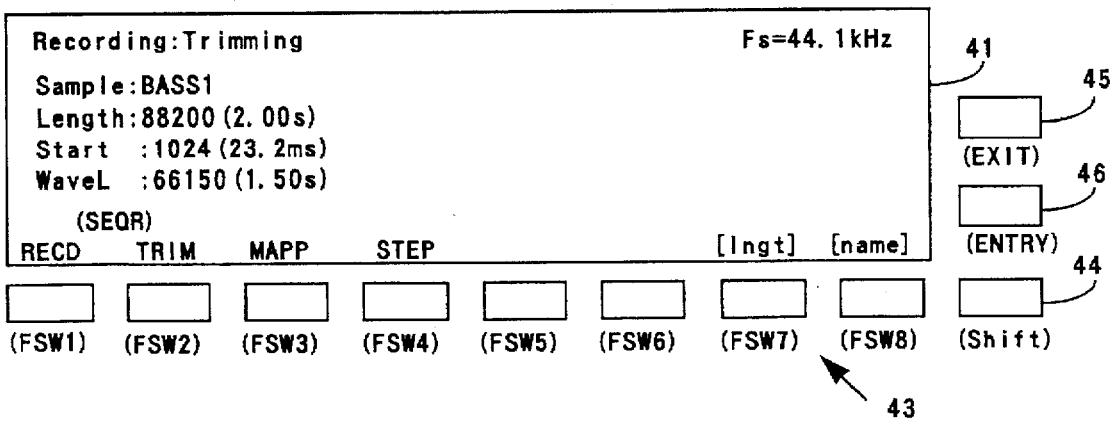
FIG. 11 depicts display of the indicator at a trimming mode.

Hereinafter, trimming processing of the read out waveform at step 408 will be described. This trimming processing is arranged to cut out unnecessary front and rear end portions of the musical tone waveform data "WV" written into the hard disk 61 thereby to write only a central portion of the musical tone waveform data "WV" into the hard disk 61. At step 408, the sampling data name (Sample: BASSI), the sampling frequency (Fs: 44.1 KHz) and the length (Length=88200(2.00 s)) of the external input sound are displayed on the indicator 41 as shown in FIG. 11, and also the start portion (Start: 1024(23.2 ms)) and length (WayeL: 66150 (1.50 s)) of the musical tone waveform data "WV" are displayed on the indicator 41. The values "Length=88200", "Start: 1024" and "WayeL: 66150" each represent the number of sample points of the musical tone waveform data. In addition, the characters indicative of the start position "Start" and length "WayeL" corresponding with the two function keys 43 are displayed on the indicator 41.

After operation of the function keys 43 corresponding with the characters "Start" and "WayeL" indicative of the start position and length, each display of the start position (Start: 1024(23.2 ms) and length (WayeL: 66150(1.50 s) of the musical tone waveform data "WV" is changed by operation of the ten-key 47 and other operation elements 48. When the entry key 46 is operated in such a condition as described above, data only for the length (WaveL) is extracted from the start position of the musical tone waveform data "WV" designated by the sampling data name (the musical tone waveform data "WV" written into the hard disk 61 by processing at step 406), and the extracted data is written into the hard disk 61 in stead of the waveform data "WV" previously extracted as the musical tone waveform data "WV" designated by the sampling data name.

Figure 12:
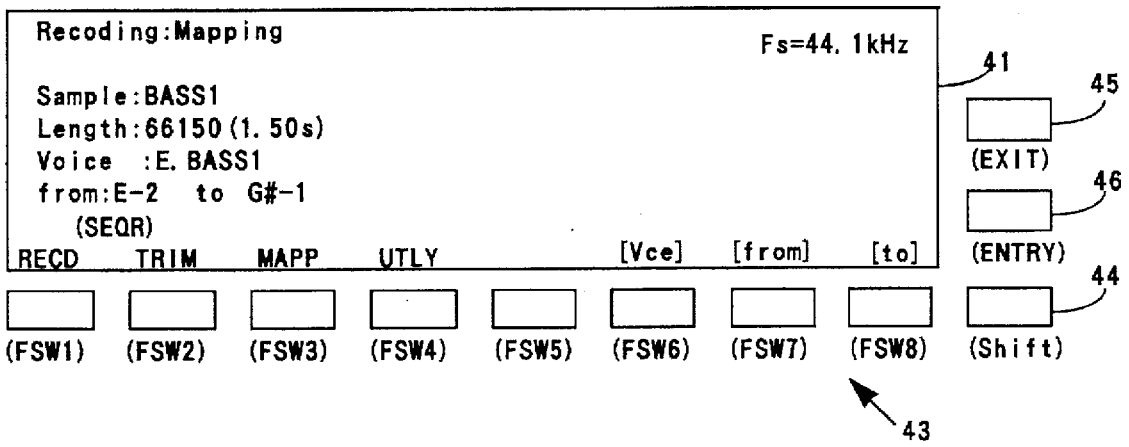
FIG. 12 depicts display of the indicator at a mapping mode.

The mapping processing at step 410 is arranged to allot the musical tone waveform data "WV" written into the hard disk 61 to the voice setting data "VOICE" (a tone color name) and a desired tone area. At step 410, the sampling frequency (Fs: 44.1 KHz), the sampling data name (Sample: BASSI) and the length (Length=66150(1.50 s) of the external input sound are displayed on the indicator 41 as shown in FIG. 12, and also the tone color name (Voice=E.BASSI) and tone area (from: E-2 to :G#-1) to be allotted are displayed on the indicator 41. In addition, the characters "Vce", "from" and "to" indicative of the tone color name and lower and upper limits of the tone area corresponding with the three function keys 43 are displayed on the indicator 41.

When the ten-key 47 and other operation element 48 are operated after operation of the function keys 43 corresponding with the characters "Vce", "from" and "to" indicative of the tone color name and the lower and upper limits of the tone area, each display of the tone color name "Vce" and the lower and upper limits "from", "to" of the tone area is changed. When the entry key 46 is operated in such a condition, a data indicative of the tone color name "Vce" and the lower and upper limits "from", "to" of the tone area allotted with the musical waveform data "WV" designated by the sampling data name "Sample" (the musical tone waveform data "WV" written into the hard disk 61 by processing at step 406 and 408) is written into the hard disk 61 in compliance with the waveform data "WV".

The processing for setting the record parameter at step 412 is arranged to set a recording level of the sampling frequency "Fs" when the external input sound is recorded in response to operation of the function key 43, ten-key 47 and other operation element 48.

The sequence processing routine at step 414 is arranged to automatically execute the sampling processing, the trimming processing and the mapping processing in sequence without designation of the modes. As shown by the flow chart in FIG. 7, the CPU 51 starts at step 420 execution of the sequence processing routine and determines at step 422 whether a sequence initial flag "SEQS" is "0" or not. Since the sequence initial flag "SEQS" is set as "0" at start of the musical tone signal producing apparatus, the CPU 51 determines a "Yes" answer at step 422 and causes the program to proceed to step 424. At step 424, the CPU 51 reads out the sampling sequence flag "SSEQF", trimming sequence flag "TSEQF" and mapping sequence flag "MSEQF" from one of the style data "ST1–ST3" designated by the style number "STN0" and sets the flags "SSEQF", "TSEQF" and "MSEQF" as first to third flags "SEQ1", "SEQ2" and "SEQ3" respectively indicative of requirement of the sampling processing, trimming processing and mapping processing during execution of the sequence processing routine. After processing at step 424, the sequence initial flag "SEQS" is set as "1" at step 426.

Figure 13:
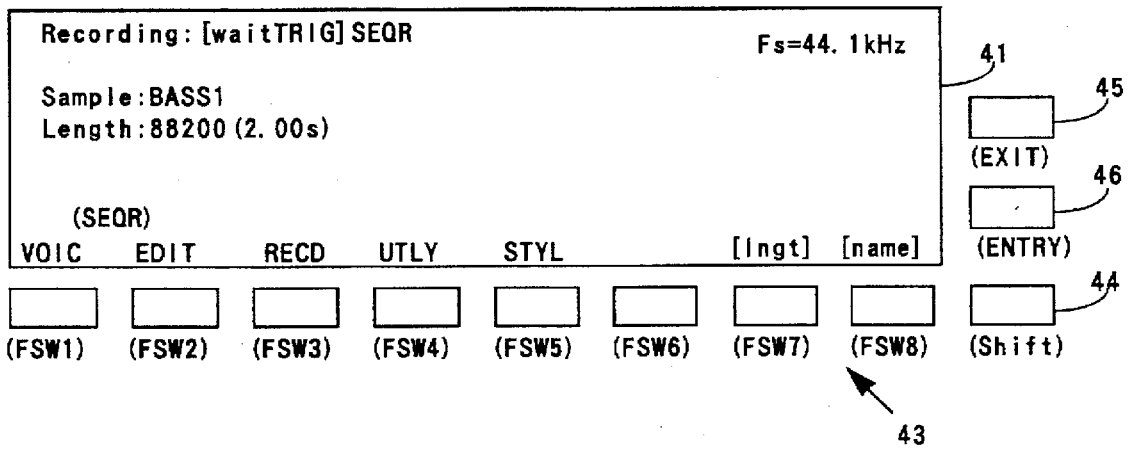
FIG. 13 depicts display of the indicator at an initial stage of the recording mode in a sequence mode.

After processing at step 422 to 426, the CPU 51 determines at step 428 whether the exit key 45 has been operated or not. If the answer at step 428 is "No", the program proceeds to step 430 where the CPU 51 determines whether the first flag "SEQ1" is "1" or not. If the first flag "SEQ1" is "0", the CPU 51 determines a "No" answer at step 430 and causes the program to proceed to step 438. If the answer at step 430 is "Yes", the program proceeds to step 432 where the CPU 51 executes the sampling processing of the external input sound. At an initial stage of the sampling processing, the indicator 41 is set in a display condition shown in FIG. 13. In this instance, the CPU 51 starts to write the waveform data "WV" converted at the external tone input interface circuit 22 into the hard disk 61 when input of an external sound has been detected at the interface circuit 22.

Figure 14:
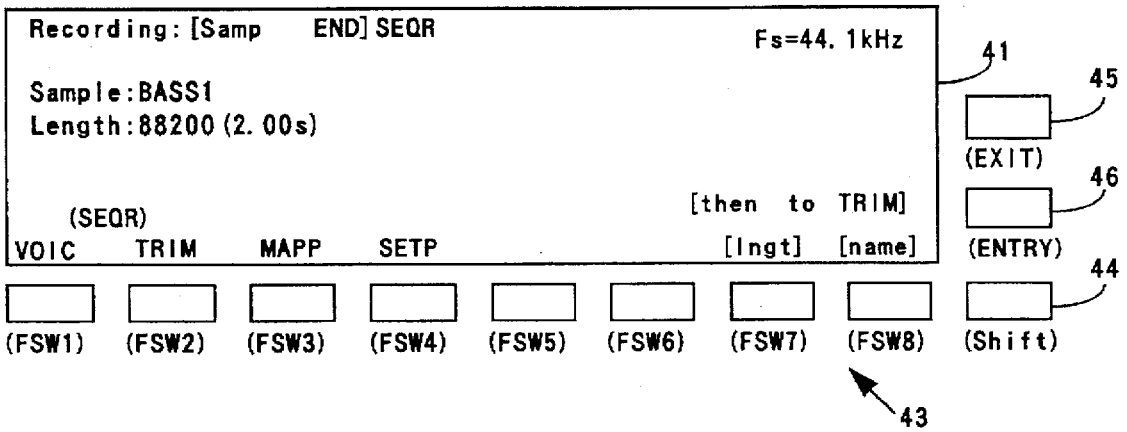
FIG. 14 depicts display of the indicator at a final stage of the recording mode in the sequence mode.

During writing of the waveform data "WV" into the hard disk 61, the program proceeds to step 434 where the CPU 51 determines whether the sampling processing has finished or not. If the answer at step 434 is "No", the program proceeds to step 462 where the CPU 51 temporarily finishes execution of the sequence processing routine. When restarted execution of the sequence processing routine after execution of the other processing, the CPU 51 executes the sampling processing at step 432. When finished execution of the sampling processing, the CPU 51 changes the display of indicator 41 at step 432 as shown in FIG. 14. Thereafter, the CPU 51 determines a "Yes" answer at step 434, resets the first flag "SEQ1" to "0" at step 436 and causes the program to proceed to step 438.

Figure 15:
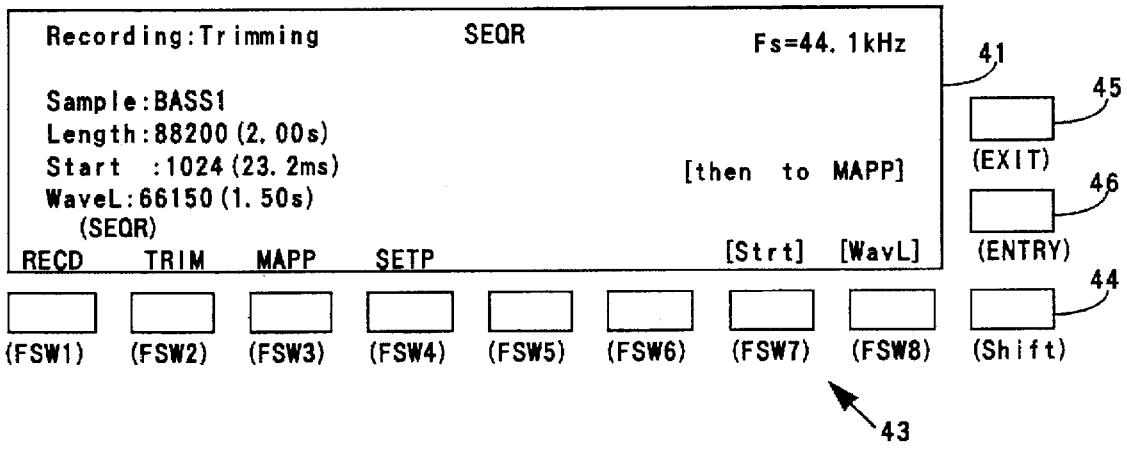
FIG. 15 depicts display of the indicator at the trimming mode in the sequence mode.

At step 438, the CPU 51 determines whether the second flag "SEQ2" is "1" or not. If the second flag "SEQ2" is "0", the CPU 51 determines a "No" answer at step 438 and causes the program to proceed to step 446. If the answer at step 438 is "Yes", the program proceeds to step 440 where the CPU 51 executes the trimming processing of the external input sound. During execution of the trimming processing, the display of indicator 41 is changed as shown in FIG. 15, and the program proceeds to step 442 where the CPU 51 determines whether the execution of the trimming processing has finished or not. If the answer at step 442 is "No", the program proceeds to step 462 where the CPU 51 temporarily finishes the execution of the trimming processing. After execution of the other processing, the CPU 51 restarts execution of the sequence processing routine. Since in this instance, the first flag "SEQ1" is reset to "0" by processing at step 424 or 436, the CPU 51 executes the trimming processing without executing the sampling processing. When finished execution of the trimming processing at step 440, the CPU 51 determines a "Yes" answer at step 442, resets the second flag "SEQ2" to "0" at step 444 and causes the program to proceed to step 446.

Figure 16:
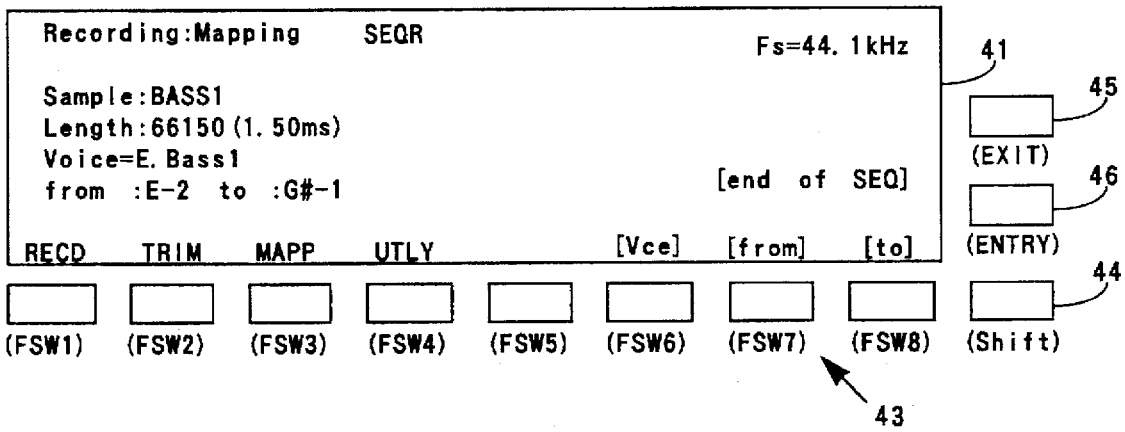
FIG. 16 depicts display of the indicator at the mapping mode in the sequence mode.

As step 446, the CPU 51 determines whether the third flag "SEQ3" is "1" or not. If the third flag "SEQ3" is "0", the CPU 51 determines a "No" answer at step 446 and causes the program to proceed to step 454. If the answer at step 446 is "Yes", the program proceeds to step 448 where the CPU 51 executes the mapping processing of the external input sound during which the indicator 41 is in a display condition shown in FIG. 16. When the program proceeds to step 450, the CPU 51 determines whether the execution of the mapping processing has finished or not. If the answer at step 450 is "No", the program proceeds to step 462 where the CPU 51 temporarily finishes the execution of the sequence processing routine. After execution of the other processing, the CPU 51 restarts execution of the sequence processing routine. Since in this instance, the first and second flags "SEQ1" and "SEQ2" each are reset to "0" by processing at step 436 and 444, the CPU 51 executes the mapping processing at step 448 without executing the sampling processing at step 432 and trimming processing at step 440. When finished execution of the mapping processing at step 448, the CPU 51 determines a "Yes" answer at step 452, resets the third flag "SEQ3" to "0" and causes the program to proceed to step 454.

At step 454, the CPU 51 determines whether all the first to third flags SEQ1–SEQ3 are "0" or not, respectively. If the answer at step 454 is "No", the program proceeds to step 462 where the CPU 51 temporarily finishes execution of the sequence processing routine. When all the first to third flags "SEQ1–SEQ3" become "0", the CPU 51 determines a "Yes" answer at step 454 and causes the program to proceed to step 456. At step 456, the CPU 51 causes the indicator 41 to display the end of the sequence processing and causes the program to proceed to step 460. Thus, the CPU 51 resets the sequence initial flag SEQS to "0" at step 460 and finishes the execution of the sequence processing routine at step 462.

When the exit key 45 is operated during execution of the sequence processing routine, the CPU 51 determines a "Yes" answer at step 428 and causes the program to proceed to step 458. At step 458, the CPU 51 changes the recording mode flag "RFLG" to a value indicative of the recording mode "RECD" and causes the program to proceed to step 460. Thus, the CPU 51 resets the sequence initial flag "SEQS" to "0" at step 460 and finishes the execution of the sequence processing routine at step 462. As a result, the system environment is changed to the recording mode, and the indicator 41 is made in the display condition shown in FIG. 10. When the exit key 45 is operated under such a condition, the operation of exit key 45 is detected by processing at step 208 of FIG. 4, and the voice mode flag "VFLG" is set as a value indicative of the voice-play mode "VOIC" by processing at step 210. Thus, the CPU 51 causes the program at step 212 to proceed to step 214. In this instance, the indicator 41 is made in the display condition shown in FIG. 9.

When the function key 43 indicated by the utility mode "UTLY" is operated in a condition where the indicator 41 is in the display condition shown in FIG. 9, the voice mode flag "VFLG" is controlled by processing at step 208 and 210 to represent the utility mode UTLY. Thus, the CPU 51 causes the program at step 212 to proceed to step 220 for execution of the utility processing. During execution of the utility processing, each processing of the RAM 53, hard disk 61 and flexible disk 63 is effected by operation of the ten-key 47 and other operation element 48.

When the function key 43 indicated by the character "STYL" of the style mode is operated in a condition where the indicator 41 is in the display condition shown in FIG. 9, the voice mode flag "VFLG" is controlled by processing at step 208 and 210 to represent the style mode STYL. Thus, the CPU 51 causes the program at step 212 to proceed to step 222 for execution of the style processing routine shown in FIG. 8. Thus, the CPU 51 starts at step 500 execution of the style processing routine and executes at step 502 administration processing of the style mode during which a style mode flag "SFLG" for designating either one of the standard mode, the load/save mode "LdSv", a style designation mode "Styl", a style name mode "Name", a copy mode "Copy" and an execution mode "Exec" in the standard mode is set in accordance with operation of the operation element detected by processing at step 208 of FIG. 4. If any one of the operation elements 43–48 is not operated, the style mode flag "SFLG" is maintained to represent the initial style designation mode "Styl". Thus, the CPU 51 causes the program at step 504 to proceed to step 506.

Figure 17:
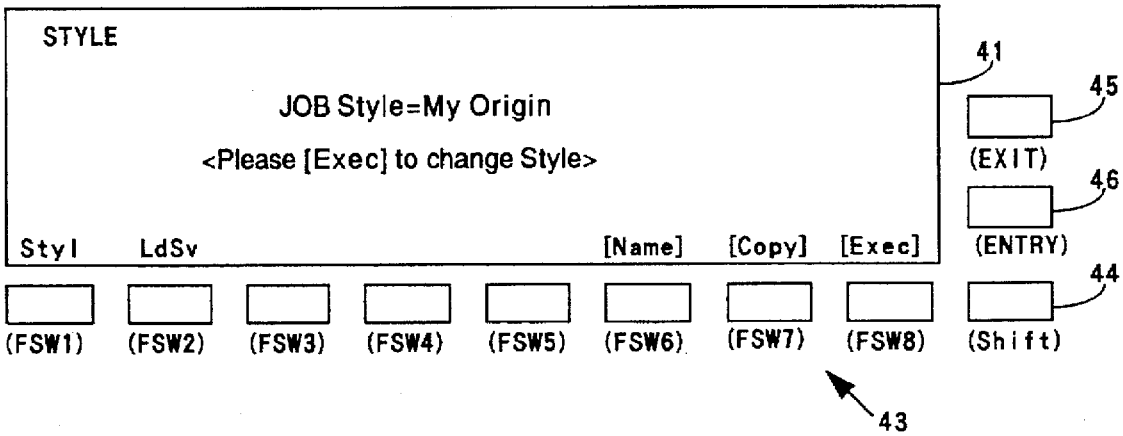
FIG. 17 depicts display of the indicator at a style mode.

At step 506, the CPU 51 reads out a name data "NAME" from one of the style data designated by the style number STN0 in the RAM 53 and supplies the read out name data "NAME" with the style mode flag "SFLG" to the display control circuit 41*a*. In turn, the display control circuit 41*a* controls the indicator 41 on a basis of the name data "NAME" in such a manner that a name (JOB Style=My Origin) of the style data represented by the name data "NAME" is displayed as shown in FIG. 17. In this instance, the indicator 41 is controlled to display the characters "Styl", "LdSv", "Name", "Copy" and "Exec" respectively indicative of the style designation mode, load/save mode, style name mode, copy mode and execution mode corresponding with the five function keys 43.

Figure 8:
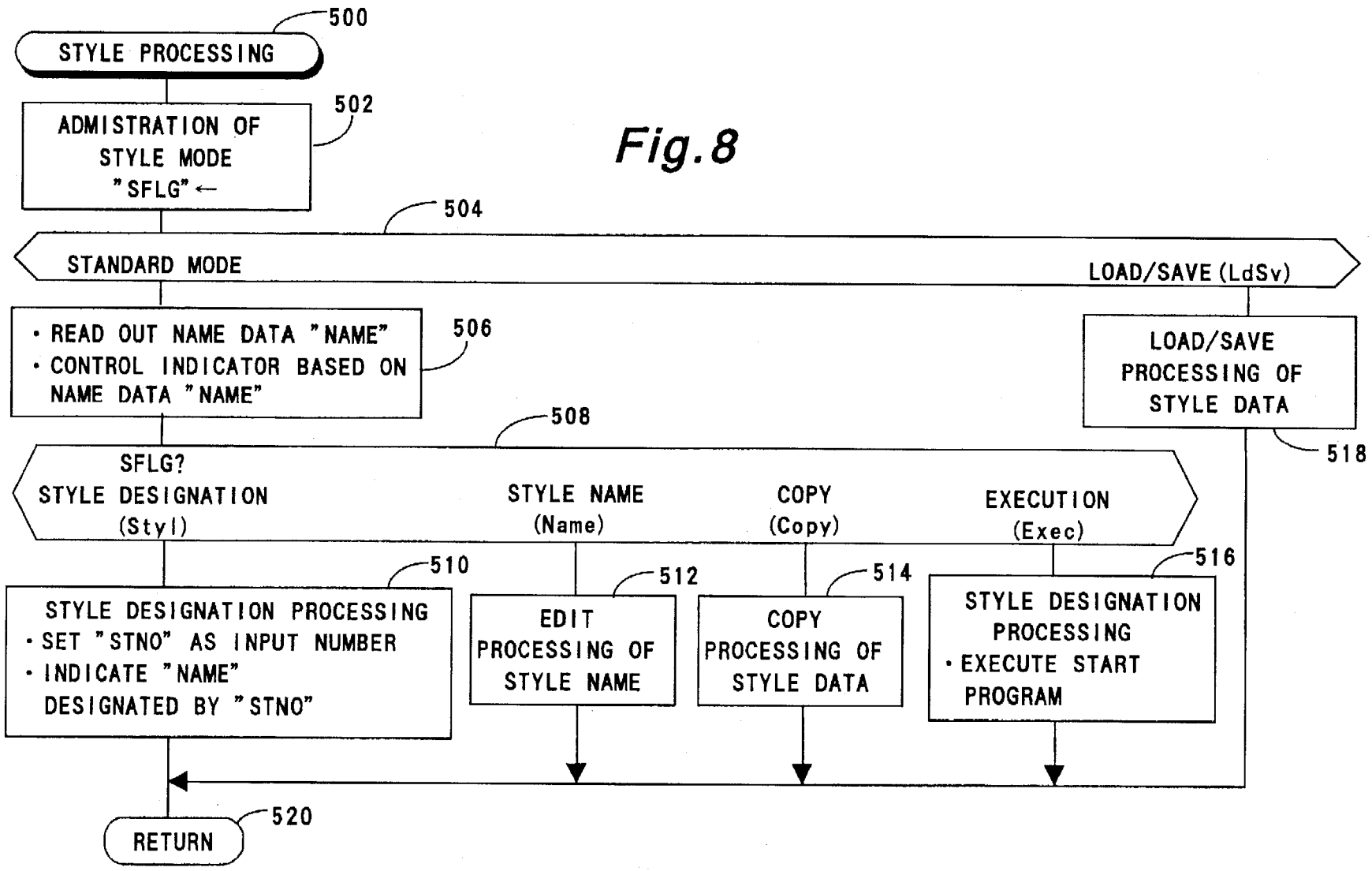
FIG. 8 is a style routine shown in FIG. 4.

When the function keys 43 indicated by the style designation mode "Styl", load/save mode "LdSv", style name mode "Name", copy mode "Copy" and execution mode "Exec" are operation in a condition where the indicator 41 is in the display condition shown in FIG. 17, each operation of the function keys 43 is detected by processing at step 208 of FIG. 4, and the style mode flag "SFLG" is set by processing at step 502 of FIG. 8 to represent the respective modes "Styl", "LdSv", "Name", "Copy" and "Exec". Thus, the program is advanced by processing at step 504 and 508 to execute processing at step 510–518. If any one of the function keys 43 is not operated, the program proceeds to step 510.

When the ten-key 47 is operated to input either one of the numbers "1"–"3" during execution of the style designation processing at step 510, the CPU 51 sets the style number "STN0" as the input number and reads out a name data "NAME" from one of the style data designated by the input number for supplying the name data "NAME" to the display control circuit 41*a*. Thus, the display control circuit 41*a* causes the indicator 41 to change the display of the name (JOB Style=My Origin) of the style data to display of a name of the style data indicative of the read out name data "NAME". This results in change of the style data or system setting data for setting a system environment at start of the musical tone signal producing apparatus.

During the edit processing of the style name at step 512, the name (JOB Style=My Origin) of the style data displayed on the indicator 41 is changed by operation of the ten-key 47 and other operation element 48, and the name data "NAME" designated by the style number STN0 is rewritten into the changed name of style data.

Figure 3:
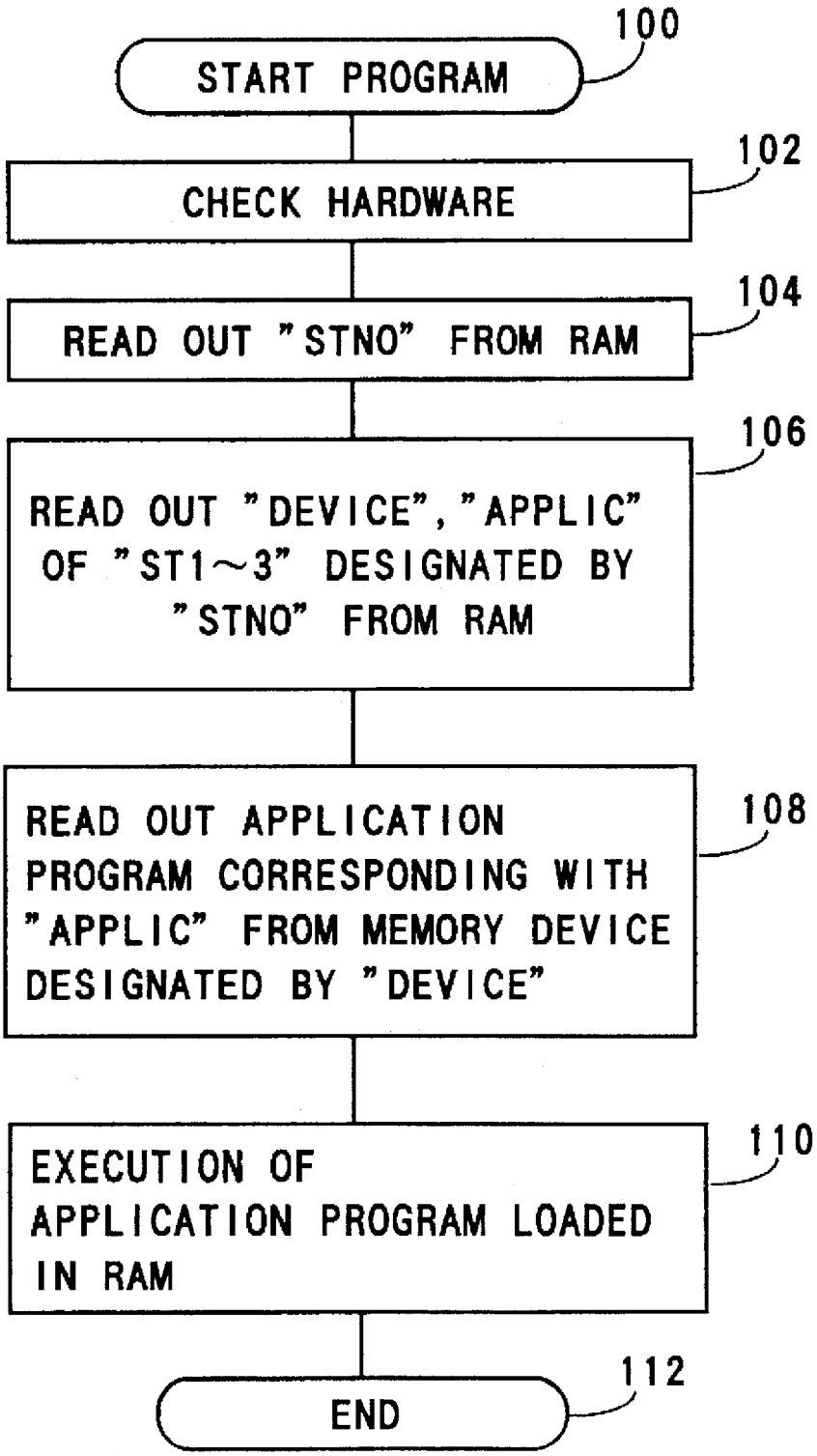
FIG. 3 is a flow chart of a start program stored in the ROM shown in FIG. 1.
Figure 18:
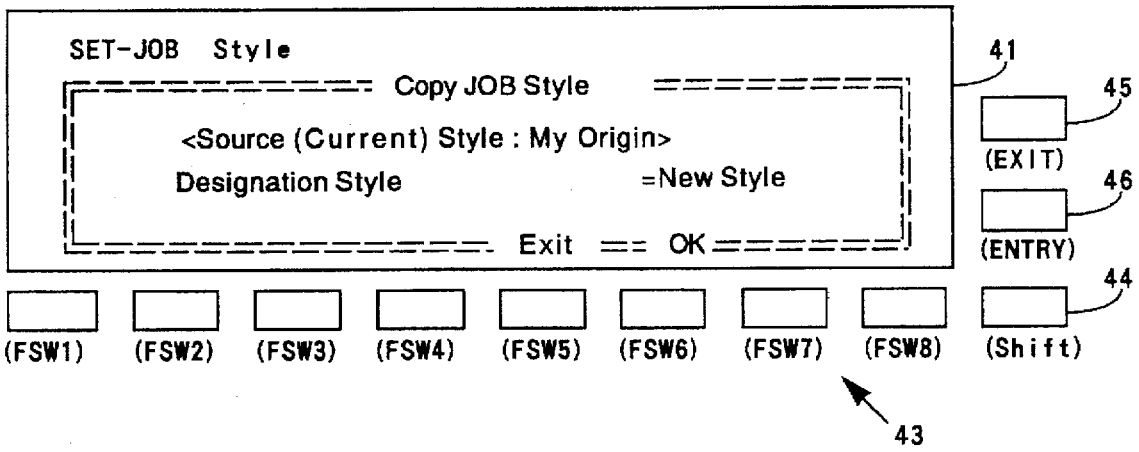
FIG. 18 depicts display of the indicator at a copy mode in the style mode.

The copy processing of the style data at step 514 is adapted to copy the style data of the hard disk 61 into the RAM 53 so as to change display of the indicator 41 as shown in FIG. 18. Prior to copy of the style data, a name (Source (Current) Style: My Origin) of style data to be copied and a name (Destination New Style) of style data to be changed are designated by operation of the ten-key 47 and other operation element 48. In such a condition, the characters "Exit" and "OK" corresponding with the two function keys 43 are displayed on the indicator 41, and the name (Source (Current) Style: My Origin) of style data designated by operation of the function key 43 corresponding with the character "OK" is copied as one of the style data ST1–ST3 into the RAM 53. In this instance, the name data "NAME" of style data in the RAM 53 becomes the designated name (Destination New Style) of style data. In addition, the style mode flag "SFLG" is changed to a value indicative of the style designation mode "Style" in response to operation of the exit key and function key 43 for the following execution of the style designation processing at step 516. During execution of the style designation processing at step 516, the start program of FIG. 3 is executed to newly set a system environment of the musical tone signal producing apparatus based on the style data ST designated by the style number STN0 as described above.

Figure 19:
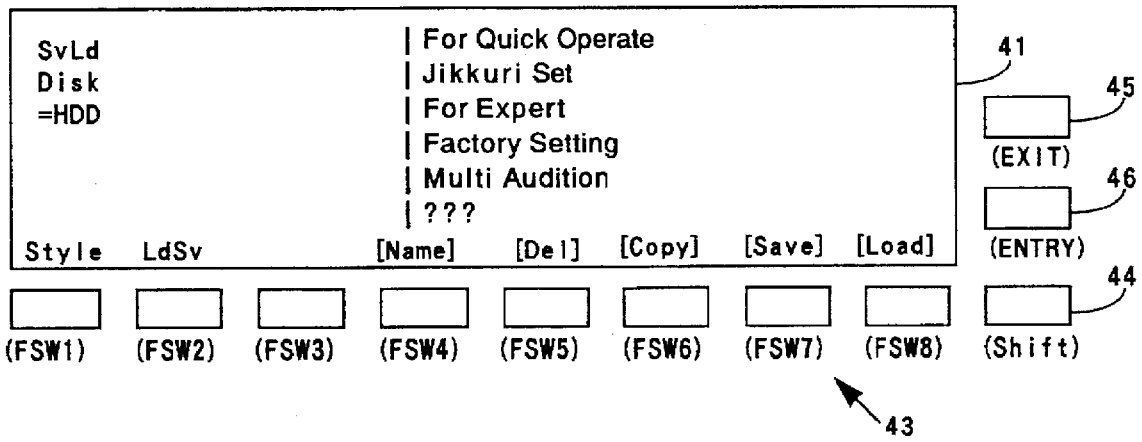
FIG. 19 depicts display of the indicator at a load/save mode in the style mode.

The load/save processing of the style data at step 518 is adapted to copy a style data between the hard disk 61 and flexible disk 63 so as to change the display of indicator 41 as shown in FIG. 19. During execution of the load/save processing, a name of style data memorized in hard disk 61 or flexible disk 63 and the characters "Save" and "Load" are displayed on the indicator 41. In such a condition, the operation element 48 is operated to coincide a cursor with a name of style data desired to save or load, and either one of the two function keys 43 is operated. With such operation of the operation element 48 and function key 43, the style data designated by the cursor is saved from the hard disk 61 into the flexible disk or vice versa. In addition, the characters of "Name", "Del" and "Copy" corresponding with the three function keys 43 are displayed on the indicator 41. Thus, the three function keys 43 are operated to change the name of style data in the hard disk 61 or flexible disk 63, to delete the style data or to copy the style data in the hard disk 61 or flexible disk 63. Since the characters "Styl" and "LdSv" of the style mode and load/save mode corresponding with the two function keys 43 are displayed on the indicator 41, the style mode flag "SFLG" can be set by operation of the functions keys 43 to the style mode "Style" and the load/save mode "LdSv". With such operation of the function keys, the style designation processing at step 510 or the load/save processing of the style data at step 518 is executed at the following style processing routine.

As is understood from the above description, the ROM 52 is adapted to memorize the start program, the RAM 53 is adapted to memorize plural sets of system setting data (the plural sets of style data "ST1–ST3") for setting the system environment of the musical tone signal producing apparatus and the designation data (the style number (STN0)) for designation of the system setting data, and each memory of the hard disk 61 and flexible disk 63 is adapted to memorize the plural kinds of application programs, the musical tone waveform data "WV1–WVm" and the tone color control data "TC1–TCm". In operation, the CPU 51 automatically starts execution of the start program shown in FIG. 3 when connected to the source of electricity by operation of the operation element 42, and in turn, the application program is designated by the device data "DEVICE" and application data "APPLIC" of the style data designated by the style number STN0. Thus, the CPU 51 reads out the application program from the hard disk 61 or the flexible disk 63 and transfers it to the RAM 53 for execution of the transferred application program. Accordingly, the musical tone signal producing apparatus can be adapted to execute various application programs stored in the hard disk 61 or flexible disk 63 in compliance with various versions and the kind of a musical instrument.

During execution of the application programs, the CPU 51 initially sets a system environment of the musical tone signal producing apparatus based on system setting data such as a style data "ST1–ST3" designated by the style number "STN0" in the RAM 53, the tuning data "MTUNE", the MIDI setting data "MIDIST", the sampling frequency data "SFREQ", the voice setting data "VOICEST" or the like and transfers a musical tone waveform data "WV1–WVm" and a tone color control data "TC1–TCm" to the waveform data buffer memory 31 and the musical tone signal producing circuit 32 on a basis of the voice setting data "VOICEST" for setting the system environment of the musical tone signal producing apparatus. (see step 202–208 in FIG. 4) Since the style data and style number "STN0" are changed by processing at step 304 of FIG. 5 and processing of the style processing routine of FIG. 8, it is able to prepare a style data for a desired system environment in accordance with the user's choice. Thus, an initial system environment of the musical tone signal producing apparatus can be set in a simple manner in accordance with the user's choice.

Figure 6:
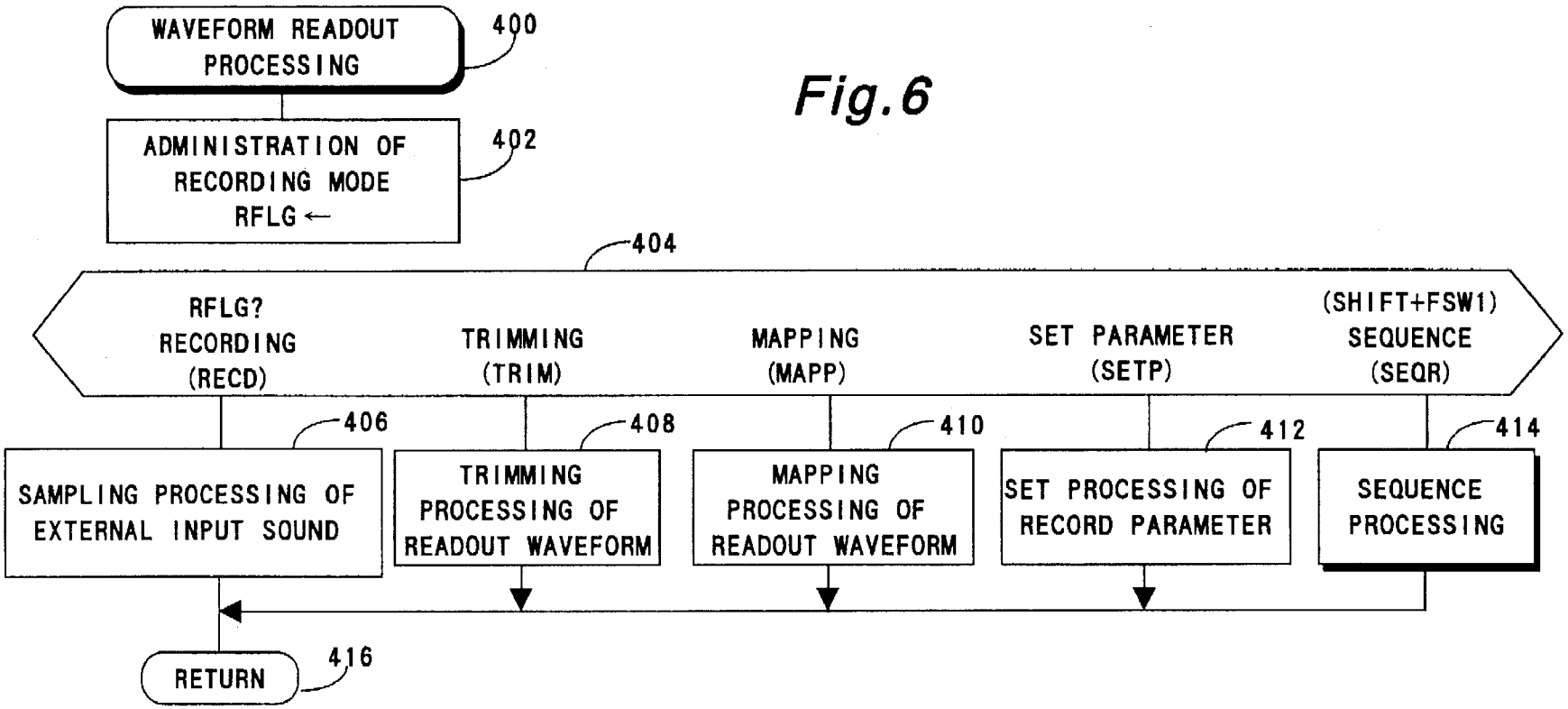
FIG. 6 is a flow chart of a waveform readout routine shown in FIG. 4.
Figure 7:
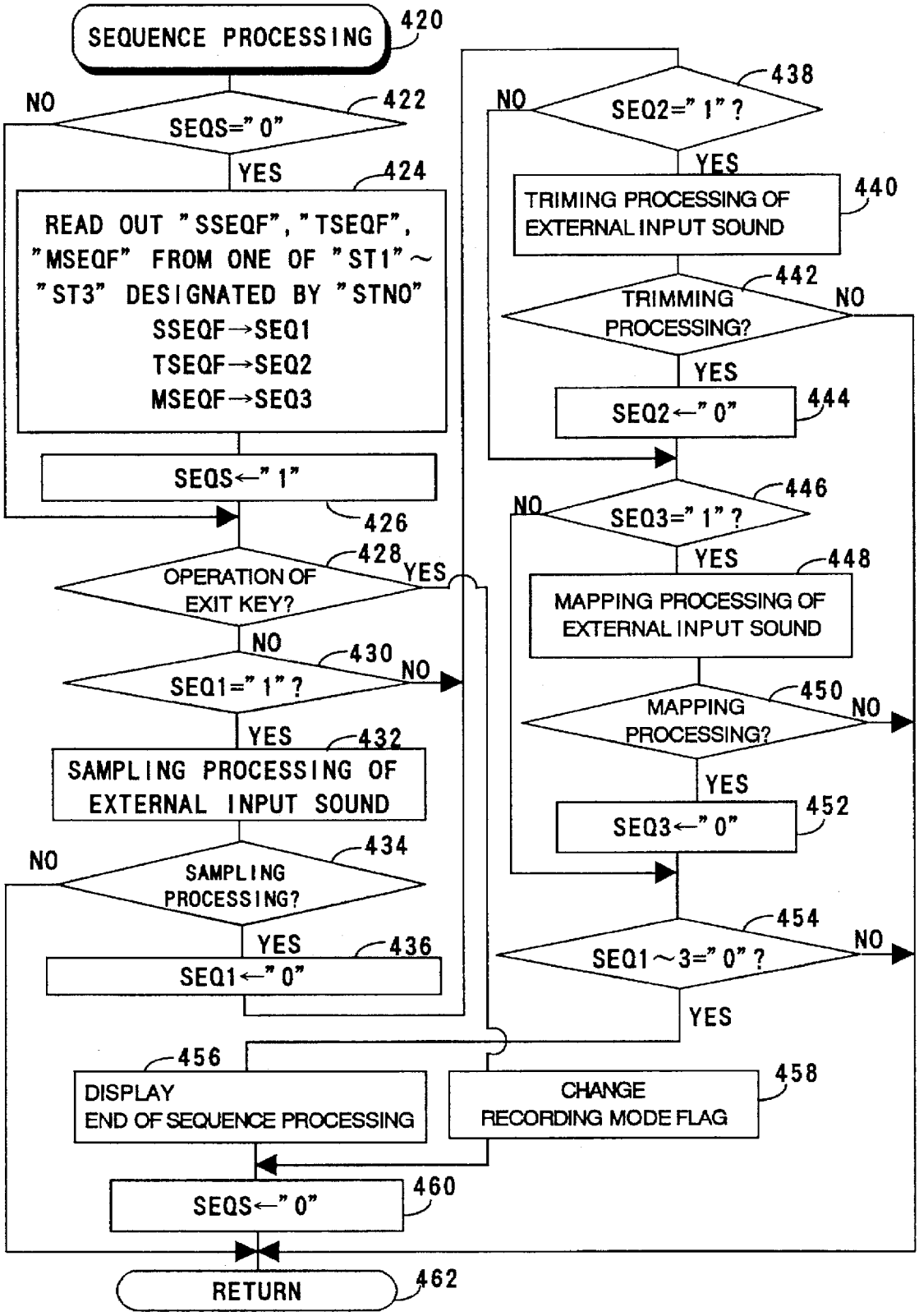
FIG. 7 is a flow chart of a sequence routine shown in FIG. 6.

During execution of the sequence processing routine for production of the musical tone waveform data shown in FIG. 6 (step 420–462 shown in FIG. 7), plural processing steps such as the sampling processing, trimming processing and mapping processing of the external input sound are automatically designated in sequence. In addition, the sampling sequence flag "SSEQF", trimming sequence flag "TSEQF" and mapping sequence flag "MSEQF" are changed or adjusted in a simple manner by processing at step 304 shown in FIG. 5. Thus, the musical tone waveform data for generation of the musical tone signal can be produced in a simple manner on a basis of the sequence and stored in the hard disk 61 or flexible disk 63. This is useful to enhance operability in production of the musical tone control data.

Although in the above embodiment, plural kinds of application programs have been prepared to be respectively started, an application program may be subdivided into plural sections such as processing for production of the waveform data, processing for setting the tone color parameter, processing for production of the automatic performance data, sound processing and the like. In such a case, each start of the plural sections is determined at start of the musical tone signal producing apparatus and set as the style data or system setting data.

Although in the above embodiment, the musical tone signal is produced in response to input of only the MIDI data, the musical tone signal may be produced in response to operation of a keyboard or various kinds of operation elements provided on the musical tone signal producing apparatus. In such a case, information indicative of each type of switches to be opened or closed in response to operation of the keyboard or operation elements is set as the style data. In addition, opening display, clock and calendar display, write inhibit display of the disk and the like may be set as the style data or system setting data.

Although in the above embodiment, the musical tone waveform data "WV" is produced on a basis of the external input sound during execution of the sequence processing, edit processing of synthetic data for tone color determination and automatic performance data may be applied to the sequence processing. In the edit processing of the synthetic data for tone color determination, each edition of the musical tone waveform data "WV", the parameter of the tone color filter, the amplitude envelope and the effect control data is determined by execution of the sequence processing. In the edit processing of the automatic performance data, each edition of the tone pitch data, the tuning data, the tone strength and the accompaniment data (chord data, bass tone data, arpeggio tone data) is determined by execution of the sequence processing. In these cases, the order of the sequence processing may be set in the form of a menu or may be registered as style data or system setting data so that the sequence processing is freely and automatically executed in accordance with the user's choice.

Furthermore, the present invention can be applied to an electronic game instrument, a personal computer or various acoustic signal generator other than the musical tone signal producing apparatus for producing a musical tone signal based on the MIDI data described above. The present invention can be also applied to a musical tone signal producing apparatus of the type wherein a fixed application program is stored in the RAM 53 or the hard disk 61.

What is claimed is:

1. A musical tone signal producing apparatus comprising:

memory means, including a plurality of memory devices, for memorizing a start program and at least one application program, wherein said application program controls production of musical tone control data and a musical tone signal based thereon; and a central processing unit for executing said start program to initiate execution of said application program by said central processing unit;

wherein designation data and plural sets of system setting data are stored in the memory means, said designation data designating one of said plural sets of system setting data and each set of said system setting data including device designating data that designates which of said plurality of memory devices is used to store said application program; and wherein the central processing unit accesses the memory device designated by the device designating data to execute said application program and sets a system environment based on said set of system setting data designated by said designation data.

2. A musical tone signal producing apparatus as recited in claim 1, wherein a plurality of application programs are stored in at least one of said plurality of memory devices, and wherein each set of said system setting data further includes application data for designating to said central processing unit which of said plurality of application programs is to be executed.

3. A musical tone signal producing apparatus as recited in claim 2, wherein said plurality of memory devices includes a read-only memory, a nonvolatile random access memory and a disk memory, wherein said start program is stored in said read only memory, wherein said plurality of application programs are stored in said disk memory, and wherein said plural sets of system setting data and said designation data are stored in said random access memory.

4. A musical tone signal producing apparatus claimed in claim 3, wherein the central processing unit transfers the application program designated by said application data from said disk memory to said random access memory for execution.

5. A musical tone signal producing apparatus as claimed in claim 1, further comprising means for editing said system setting data.

6. A musical tone signal producing apparatus as claimed in claim 1, further comprising means for editing said designation data.

7. A musical tone signal producing apparatus as claimed in claim 1, wherein said application program includes a sequence processing routine for producing said musical tone control data.

8. A musical tone signal producing apparatus as claimed in claim 7, wherein said sequence processing routine comprises a sampling process, a trimming process and a mapping process of an external input sound signal.

* * * * *